US005508155A

United States Patent [19]

Marrese et al.

[11] Patent Number: 5,508,155

[45] Date of Patent: Apr. 16, 1996

[54] PHOTOGRAPHIC COLOR DEVELOPERS CONTAINING ODORLESS ANTIOXIDANTS FORMED IN SITU FROM REACTION OF HYDROXYLAMINE AND EPOXIDE AND USE OF SAME

[75] Inventors: Carl A. Marrese, Penfield; Paul A. Zielinski, Rochester, both of N.Y.

[73] Assignee: Eastman Kodak Company, Rochester, N.Y.

[21] Appl. No.: 362,282

[22] Filed: Dec. 22, 1994

[51] Int. Cl.[6] ..... G03C 5/18; G03C 5/26; G03C 11/00

[52] U.S. Cl. ..... 430/490; 430/428; 430/372; 430/442; 430/467; 430/469

[58] Field of Search ..... 430/490, 428, 430/372, 442, 467, 469

[56] References Cited

U.S. PATENT DOCUMENTS

| | | | |
|---|---|---|---|
| 1,663,959 | 3/1928 | Schestakoff | 430/490 |
| 3,806,345 | 4/1974 | Willems et al. | 96/66 R |
| 4,814,260 | 3/1989 | Koboshi et al. | 430/490 |
| 5,071,734 | 12/1991 | Ueda et al. | 430/372 |
| 5,091,292 | 2/1992 | Fujimoto et al. | 430/467 |
| 5,094,937 | 3/1992 | Morimoto | 430/485 |
| 5,100,765 | 3/1992 | Fujimoto | 430/434 |
| 5,108,880 | 4/1992 | Adkins | 430/490 |
| 5,147,766 | 9/1992 | Ishikawa et al. | 430/399 |
| 5,153,111 | 10/1992 | Yoshida et al. | 430/444 |
| 5,354,646 | 10/1994 | Kobayashi et al. | 430/372 |

FOREIGN PATENT DOCUMENTS

| | | | |
|---|---|---|---|
| 530921A1 | 3/1993 | European Pat. Off. . | |
| 565315A2 | 10/1993 | European Pat. Off. . | |
| 63-40149 | 2/1988 | Japan | 430/490 |
| 63-32549 | 2/1988 | Japan | 430/490 |
| 1116944 | 6/1968 | United Kingdom | 430/490 |

*Primary Examiner*—Charles L. Bowers, Jr.
*Assistant Examiner*—J. Pasterczyk
*Attorney, Agent, or Firm*—J. Lanny Tucker

[57] ABSTRACT

Substituted hydroxylamine antioxidants can be prepared by reacting hydroxylamine or a mono-substituted hydroxylamine with an epoxide. The antioxidant reaction product is not removed from the reaction mixture, but is used without separation after combination with a color developer to provide a photographic color developer composition. The antioxidants are highly water soluble and thus exhibit no objectionable odor.

14 Claims, 1 Drawing Sheet

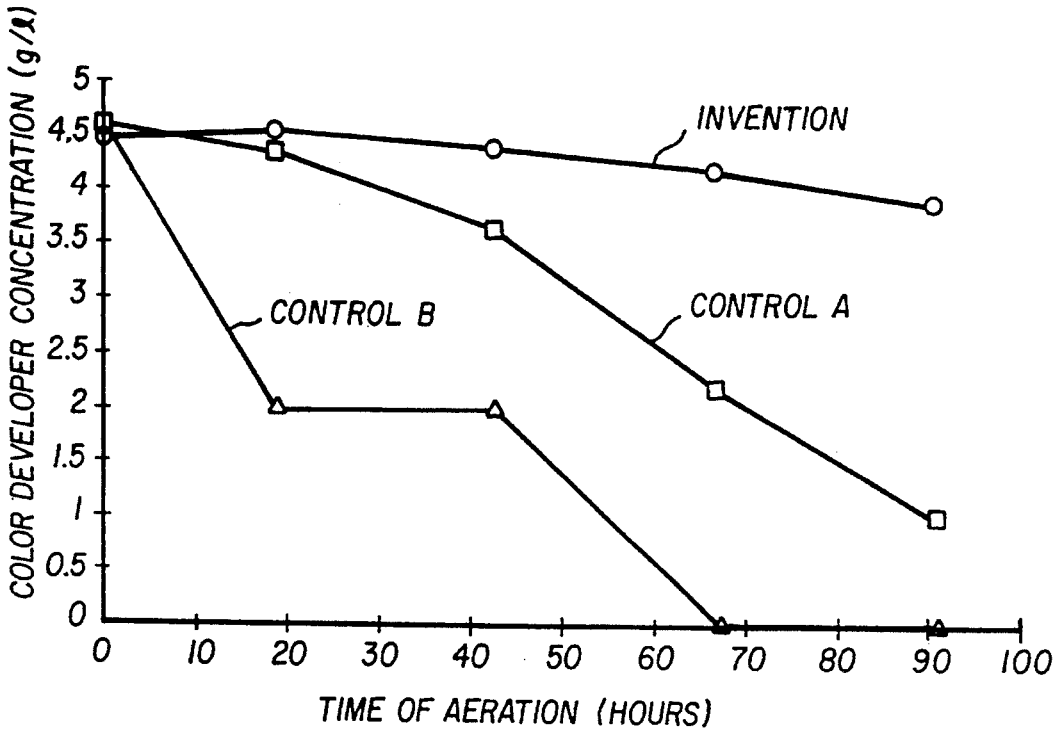
COLOR DEVELOPER CONCENTRATION (g/ℓ)
5
4.5
4
3.5
3
2.5
2
1.5
1
0.5
0
INVENTION
CONTROL B
CONTROL A
0
10
20
30
40
50
60
70
80
90
100
TIME OF AERATION (HOURS)

PHOTOGRAPHIC COLOR DEVELOPERS CONTAINING ODORLESS ANTIOXIDANTS FORMED IN SITU FROM REACTION OF HYDROXYLAMINE AND EPOXIDE AND USE OF SAME

FIELD OF THE INVENTION

The present invention relates to a color photographic developer composition and to its use in the processing of silver halide color photographic materials. More specifically, it relates to color developer compositions having improved stability because of antioxidants formed in situ.

BACKGROUND OF THE INVENTION

Developing solutions are used to process color photographic materials such as color photographic films and papers to provide the desired color images. Such solutions generally contain developing agents, for example 4-amino-3-methyl-N-(β-methanesulfonamidoethyl)aniline, as reducing agents to react with suitable color forming couplers to form the desired dyes. However, such developing agents are susceptible to oxidation by dissolved oxygen. An antioxidant is conventionally included in the developer solutions to preserve the oxidation state of the color developer and thereby maintain useful color developer activity.

Many classes of compounds have been employed as color developer solution antioxidants, including hydroxylamines, hydroxamic acids, oximes, nitroxy radicals, hydrazines, hydrazides, phenols, saccharides, various simple amines, polyamines, quaternary ammonium salts, α-hydroxy ketones, alcohols, diamides and disulfonamides. To be used in practice, however, antioxidants must be soluble in aqueous media, non-toxic to living organisms, low cost and non-silver halide developers. Further, it is desirable that antioxidants react slowly with oxygen and rapidly with oxidized color developer, but not so rapidly that color development is retarded. Yet another concern is that the antioxidant must not be able to promote bacterial growth.

All of these considerations greatly limit the number and classes of compounds that practically can be used as antioxidants or stabilizers in color developer solutions. The compounds most often used as antioxidants are hydroxylamines. They exhibit excellent characteristics by having a slow rate of aerial oxidation, being non-silver halide developers, and are relatively inexpensive to produce. There are considerable publications describing such compounds.

Unfortunately, many hydroxylamines have significant vapor pressure at room temperatures, and have a characteristic unpleasant odor.

Considerable work has been carried out to improve various features of hydroxylamines, including their water-solubility so that odors from the release of amines is minimized. Thus, various solubilizing groups, including hydroxyl, carboxyl and sulfonyl groups have been put on hydroxylamines through simple reactions to reduce the odor problem.

Using hydroxyl side groups as a water solubilizing moieties additionally improves the stability of hydroxylamines toward catalytic decomposition by lessening their ability to leach metal ions from metal equipment used in processing. The presence of trace metal ions in processing solutions is known to catalyze hydroxylamine decomposition through aerial oxidation (Moews et al, *J. Inorg. Nucl.Chem.*, 11, 242, 1959).

Known procedures for preparing hydroxylamines having solubilizing groups, including hydroxyl groups, typically include one or more synthetic reaction steps and isolation of the product which is then added to color developer solutions. There is a need for a simplified way to provide odorless color developer antioxidants which is cost effective and which provides antioxidants at least as effective as compounds prepared using conventional means.

SUMMARY OF THE INVENTION

The problems noted above have been overcome with a photographic color developer composition comprising:

a) a photographic color developer, and b) a substituted hydroxylamine antioxidant which has the structure (I):

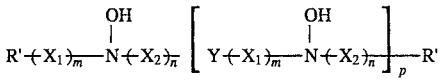

wherein

R' is hydrogen, an alkyl group of 1 to 10 carbon atoms, a hydroxyalkyl group of 1 to 10 carbon atoms, a cycloalkyl group of 5 to 10 carbon atoms, or an aryl group having 6 to 10 carbon atoms in the aromatic nucleus, $X_1$ has the structure (II):

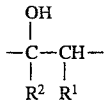

and $X_2$ has the structure (III):

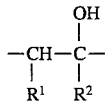

wherein $R^1$ and $R^2$ are independently hydrogen, an alkyl group of 1 to 2 carbon atoms, or a hydroxyalkyl group of 1 to 2 carbon atoms, or $R^1$ and $R^2$ together represent the carbon atoms necessary to complete a 5- to 8-membered saturated or partially saturated carbocyclic ring structure, Y is an alkylene group of at least 4 carbon atoms and has an even number of carbon atoms, or Y is a divalent aliphatic group having an even total number of carbon and oxygen atoms in the chain, provided that the aliphatic group has at least 4 atoms in the chain, m, n and p are independently 0 or 1, the antioxidant being a reaction product formed in a reaction mixture from the reaction of:

1) hydroxylamine or a mono-substituted hydroxylamine, and 2) an epoxide having either the structure (IV):

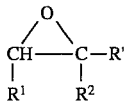

or (V):

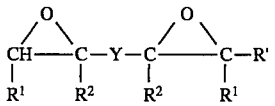

wherein R', $R^1$, $R^2$ and Y are defined above, the reaction product remaining in the reaction mixture for use as an antioxidant when mixed with the photographic color developer.

This invention also provides a method for preparing a photographic color developer composition comprising:

A) preparing the substituted hydroxylamine antioxidant in a reaction mixture as described above, and B) without separation of the antioxidant from the reaction mixture, mixing the antioxidant with a photographic color developer.

Further, a method of this invention for developing a color photographic element comprises treating an imagewise exposed, color photographic element with the color developer composition described above.

Moreover, this invention also provides a color developer precursor reaction mixture comprising:

a) hydroxylamine or a mono-substituted hydroxylamine, and b) an epoxide as described above.

The present invention provides a highly useful color developer solution which is stable to aerial oxidation because of the presence of a suitable substituted hydroxyamine as the antioxidant. Moreover, this antioxidant is highly water-soluble, thereby reducing the objectionable odor that might otherwise be present. The solubilizing groups are added to the hydroxylamine starting material in a simple synthetic procedure using an epoxide as a co-reactant. The resulting antioxidant product can be mixed with a color developer solution immediately without isolation from its reaction medium, or diluted and stored for later mixing. Thus, the present invention provides a water-soluble, odorless, inexpensive antioxidant in a simple and cost effective manner.

BRIEF DESCRIPTION OF THE DRAWING

FIG. 1 is a graphical presentation of data produced in Example 2 below, relating color developer concentration to time of aeration.

DETAILED DESCRIPTION OF THE INVENTION

As noted above, the color developer compositions of this invention are prepared by mixture a photographic color developer with a substituted hydroxylamine antioxidant prepared as described below. Generally, the antioxidant is prepared from the reactants in a reaction mixture and used in that reaction mixture without separation therefrom. In this manner, the antioxidant is considered to have been prepared in situ, and not separated in any manner from the reaction mixture before use. It is not necessary, however, that the reaction mixture containing the reactants be used immediately. Rather, it can be stored for later use, or mixed with the color developer and then stored for later use. By "separation" is meant any physical or chemical means for taking the substituted hydroxylamine reaction product from the reaction mixture prior to use with the color developer. This costly and time consuming separation step(s) is avoided with the practice of this invention.

Hydroxylamine or mono-substituted hydroxylamines are useful as one reactant in the practice of the present invention can be generally defined as hydroxylamines having one monovalent aliphatic substituent connected to the nitrogen atom. Such substituents are well understood in the art as including monovalent acyclic or cyclic hydrocarbon groups and monovalent heterocyclic groups. Mono-substituted hydroxylamines are described, for example, in U.S. Pat. No. 5,091,292 (Fujimoto et al), U.S. Pat. No. 5,094,937 (Morimoto et al), U.S. Pat. No. 5,100,765 (Fujimoto), among other publications.

More specifically, the useful hydroxylamines can be defined by the structure VI:

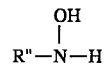

wherein R" is a substituted or unsubstituted alkyl group of 1 to 10 carbon atoms (such as methyl, ethyl, propyl, isopropyl, hydroxymethyl, 2-hydroxyethyl, pentyl, t-butyl, benzyl and octyl), a substituted or unsubstituted cycloalkyl group of 5 to 10 carbon atoms (such as cyclopentyl, cyclohexyl, 4-methylcyclohexyl and cyclooctyl) or a substituted or unsubstituted aryl group of 6 to 10 carbon atoms (such as phenyl, naphthyl, xylyl, 4-hydroxyphenyl and tolyl).

Particularly useful mono-substituted hydroxylamines include, but are not limited to, N-methylhydroxylamine, N-isopropylhydroxylamine, and N-cyclohexylhydroxylamine. The first compound is a preferred reactant.

The hydroxylamine or mono-substituted hydroxylamines described above are reacted under suitable conditions (described below) with a mono-, di-, tri- or tetra-substituted epoxide, that is, epoxides having one to four substituents on the two carbons in the epoxide ring. Such substituents include those defined above for the hydroxylamines.

More specifically, however, these compounds can be defined as having either structure (IV):

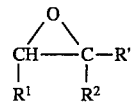

or (V):

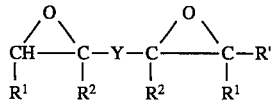

wherein R' is hydrogen, an alkyl group of 1 to 10 carbon atoms (such as methyl, ethyl, isopropyl,. t-butyl, pentyl, hexyl, benzyl, octyl, decyl and 3-methylhexyl). By "alkyl group" is meant any unsubstituted linear or branched alkyl having the noted carbon atoms, as well as a linear or branched alkyl substituted with one or more phenyl or hydroxyphenyl groups, as long as the maximum number of carbon atoms is not exceeded. Preferably, R' is a substituted or unsubstituted alkyl group of 1 to 7 carbon atoms, and more preferably, it has 1 to 3 carbon atoms.

R' can also be a hydroxyalkyl group of 1 to 10 carbon atoms (such as hydroxymethyl, 2-hydroxyethyl, 1-hydroxyethyl, 2-hydroxypropyl, 2,3-dihydroxypropyl, 1-hydroxyoctyl and 1,3-dihydroxydecyl). By "hydroxyalkyl group" is meant an alkyl group having the noted carbon atoms substituted with one or more hydroxy groups anywhere on the molecule that is technically possible, as well as alkyl groups which have other substituents as defined above for "alkyl group". Preferably, in this embodiment, R' is a hydroxyalkyl group of 1 to 3 carbon atoms having only one hydroxyl group, and more preferably, it is hydroxymethyl.

In the noted formulae, R' can also be an aryl group having 6 to 10 carbon atoms in the ring structure (such as phenyl, xylyl, tolyl, naphthyl and 4-hydroxyphenyl). By "aryl group" is meant an unsubstituted phenyl or naphthyl group, or one of those groups having one or more alkyl (as defined above) or hydroxy substituents at any position of the ring which does not interfere with the reactive properties or solubility of the epoxide. The aryl group can also include a phenyl ring having non-aromatic carbocyclic or heterocyclic ring structures fused thereto. Preferably, when R' is an aryl group, it is phenyl.

R' can also be a cycloalkyl group having 5 to 10 carbon atoms in the ring structure (such as cyclopentyl, cyclohexyl, 4-methylcyclohexyl and 3-hydroxycyclohexyl). By "cycloalkyl group" is meant any unsubstituted cycloalkyl having the requisite carbon atoms, as well as cycloalkyl rings substituted with one or more alkyl (as defined above) or hydroxyl groups. Preferably, as a cycloalkyl group, R' is cyclohexyl.

$R^1$ and $R^2$ are independently hydrogen, a substituted or unsubstituted alkyl group (as defined above) of 1 to 2 carbon atoms, or a substituted or unsubstituted hydroxyalkyl group (as defined above) of 1 to 2 carbon atoms.

Alternatively, $R^1$ and $R^2$ together can represent the carbon atoms necessary to complete a 5- to 8-membered saturated or partially saturated carbocyclic ring structure (of one or more fused rings) which can be unsubstituted or substituted with one or more alkyl groups of 1 to 3 carbon atoms (as defined above) or one or more hydroxyalkyl groups of 1 to 3 carbon atoms (as defined above). By "partially saturated" is meant that the ring structure contains at least one double bond, but the ring structure is not aromatic.

In one embodiment, Y is defined as an alkylene group of at least 4 carbon atoms and having an even number of carbon atoms in the chain. By "alkylene group" is meant a branched or linear unsubstituted alkylene (such as methylene, dimethylene and trimethylene) as well as an alkylene group which has one or more substituents which are simple alkyl groups of 1 to 2 carbon atoms or hydroxy.

In another embodiment, Y is a divalent aliphatic group in which the sum of carbon and oxygen atoms in the chain is an even number, provided there are at least 4 atoms in the chain. Such groups can be substituted or unsubstituted oxyalkylene, alkyleneoxy, oxyalkylene, oxyalkyleneoxy, alkyleneoxyalkylene, and similar combinations of such groups which would be readily apparent to one skilled in the art.

Particularly useful epoxides in the practice of this invention include the following compounds: glycidol, 2-methyl-2,3-epoxy-1-propanol, 4-phenyl-2,3-epoxy-l-butanol, 1,4-butanediol diglycidyl ether and 1,2,7,8-diepoxyoctane. Glycidol is most preferred.

The di-substituted hydroxylamines useful in the practice of this invention are prepared using the following general procedure and conditions.

One or more hydroxylamines (or their salts) and one or more epoxides are added simultaneously or sequentially to water for reaction. When a hydroxylamine salt is used, it and the epoxide are added to an aqueous basic solution containing a stoichiometric amount of a base (for example, bicarbonate) which generally has a pH of at least 8 (preferably from 8 to 9). Once each reactant is dissolved in this reaction mixture, reaction is allowed to proceed for at least 8 hours (preferably up to 24 hours) with suitable agitation and at a temperature from about 10 to about 40° C. (preferably at room temperature). The resulting reaction mixture containing the antioxidant reaction product can be used without further changes, or it can be diluted or concentrated for storage.

The reactants used in making the antioxidant can be obtained from a number of commercial sources, including but not limited to, Eastman Chemicals Company, Fisher Scientific and Aldrich Chemical Company. Alternatively, it would not be difficult for a skilled worker to make the noted epoxides or mono-substituted hydroxylamines using known procedures and readily available starting materials.

The resulting mono- or di-substituted hydroxylamine antioxidant can be defined by the structure (I)

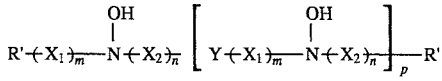

wherein R', $R^1$, $R^2$ and Y are as defined above. In addition, p is 0 or 1 (preferably, p is 0), m and n are independently 0 or 1, and preferably each is 1. $X_1$ has the structure (II):

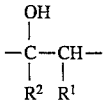

and $X_2$ has the structure (III):

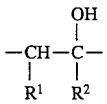

Specific di-substituted hydroxylamine antioxidants prepared by and useful in this invention include, but are not limited to: N,N-bis(2,3-dihydroxypropyl)hydroxylamine, N,N-bis(2-methyl-2,3-dihydroxypropyl)hydroxylamine and N,N-bis(1-hydroxymethyl-2-hydroxy-3-phenylpropyl)hydroxylamine. The first compound is preferred.

More than one antioxidant can be included in the compositions of this invention by mixing the appropriate multiple epoxide and mono-substituted hydroxylamine reactants in the reaction mixture. Preferably, however, only one antioxidant is used in each color developer composition.

The color developer compositions of the present invention include one or more color developing agents, of which there are hundreds of possibilities. Useful classes of such materials include, but are not limited to, aminophenols, p-phenylenediamines (especially N,N-dialkyl-p-phenylenediamines) and others which are well known in the art. Further details of such materials are provided in *Research Disclosure*, publication 36544, pages 501–541 (September, 1994), and references cited therein. Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

The color developer composition can be easily prepared by mixing a suitable color developer (in a suitable solution) with a portion of the original reaction mixture (diluted or concentrated) containing the antioxidant as described above. Water can be added to the resulting composition to provide the desired concentrations, and the pH can be adjusted to the desired value with a suitable base (such as sodium hydroxide).

The color developer composition of this invention can include one or more of a variety of other addenda which are commonly used in such compositions, such as alkali metal halides (such as potassium chloride, potassium bromide, sodium bromide and sodium iodide), metal sequestering agents (such as aminopolycarboxylic acids), buffers to maintain pH from about 9 to about 13 (preferably from about 9 to about 11), such as carbonates, phosphates and borates, preservatives, development accelerators, optical brightening agents, wetting agents, surfactants and water-soluble or water-dispersible couplers as would be understood by one skilled in the art (see for example, *Research Disclosure*, noted above). The amounts of such additives are well known in the art also.

The color developing composition of this invention has obvious utility to provide color development in an imagewise exposed color photographic element comprising a support and one or more silver halide emulsion layers containing an imagewise distribution of developable silver halide emulsion grains. A wide variety of types of photographic elements (both color films and color papers) containing various types of emulsions can be processed using the present invention, the types of elements being well known in the art (see *Research Disclosure*, noted above). In particular, the invention can be used to process color photographic papers. The development composition can also be used in color reversal processing.

Development is carried out by contacting the element under suitable time and temperature conditions, in suitable processing equipment, to produce the desired developed image. Additional processing steps can then be carried out using conventional procedures, including but not limited to, steps of stopping development, bleaching, fixing (or bleach/fixing), washing (or rinsing), stabilizing and drying, in any particular desired order. Useful processing steps, conditions, and materials are well known (see for example, *Research Disclosure*, noted above).

The following examples are provided to illustrate the practice of the invention and not to limit it in any way. Unless otherwise indicated, percentages are by weight.

EXAMPLE 1

Preparation of Di-Substituted Antioxidant

This example demonstrates a typical procedure for preparing antioxidants according to the present invention.

Hydroxylamine sulfate (20.51 g) was added to an aqueous solution of sodium bicarbonate (250 ml, 1 mol/liter). Following dissolution of the hydroxylammonium sulfate, glycidol (37.04 g) was added, and the reaction was allowed to proceed at room temperature for 13 hours with stirring.

$^{13}C$ NMR attached proton test (APT) data (measured in dimethylsulfoxide) were consistent with the expected reaction product, N,N-bis(2,3-dihydroxypropyl)hydroxylamine: Chemical shifts, 64.60 and 64.86 (C-1 or C-3), 69.45 (C-2). The hydroxyl groups impart a high degree of water solubility to the compound. Consequently, solutions of this highly water soluble compound did not yield any objectionable amine odor. The final solution was diluted with distilled water to 1 liter to give a final antioxidant concentration of 0.25 mol/l.

EXAMPLE 2

Preparation of Color Developer Composition

This example demonstrates the preparation of a useful photographic color developer composition according to the present invention. The components of the composition as shown in Table I below, were mixed together.

TABLE I

| Component | Concentration/ liter |
|---|---|
| Lithium salt of sulfonated polystyrene (30% w/w) | 0.25 ml |
| Triethanoluffine | 11 ml |
| KODAK EKTAPENT ™2 Stain | 2.3 g |
| Reducing Agent | |
| N,N-bis(2,3-dihydroxypropyl) hydroxylamine (0.25 mol/l)* | 200 ml |
| Lithium sulfate | 2.7 g |
| 1-Hydroxyethylidene-1-diphosphonic acid (60% w/w) | 0.8 ml |
| Potassium chloride | 1.8 g |
| Potassium bromide | 0.2 g |
| 4-Amino-3-methyl-N-ethyl-N-(β-methanesulfonamidoethyl)aniline | 4.85 g |
| Potassium carbonate | 25 g |
| Water to 1 liter solution | |
| pH adjusted to 10.12 with sodium hydroxide | |

*Solution of Example 1.

The developer composition (Invention) was subjected to aeration by bubbling air through 1 liter of the solution of Example 1 at a rate of 0.5 standard $ft^3$/hr (0.014 m3/hr). The concentration of color developer was measured by high performance liquid chromatography as a function of time.

For comparison purposes, another developer solution (Control A) containing the exact formulation as noted above was prepared except that N,N-diethylhydroxylamine (a common antioxidant) was used in place of N,N-bis(2,3-dihydroxypropyl)hydroxylamine at the same concentration. Both compounds were left out of a third formulation (Control B). After aeration of these solutions, the amount of color developer was measured as noted above. The results of these analyses are shown in FIG. 1.

It is evident that the antioxidant used accordance with the present invention from Example 1 (without separation from the reaction mixture) provided superior stabilization of the color developer, and thus prolonged the usefulness of the color developer solution.

EXAMPLE 3

Processing Photographic Element

The color developer solutions (Control A and Example 2) described above were used to process samples of a silver halide photosensitive paper, namely KODAK EKTACOLOR™ paper, which had been imagewise exposed. The following densitometry results in Table II indicate that the solution of the present invention provided suitable densitometric results.

TABLE II

| Color Records | $D_{Min}$ | $D_{Max}$ | Relative Speed |
|---|---|---|---|
| Invention | | | |
| Red | 0.105 | 2.451 | 132.3 |
| Green | 0.087 | 2.432 | 128.1 |
| Blue | 0.063 | 2.040 | 146.2 |

TABLE II-continued

| Color Records | $D_{Min}$ | $D_{Max}$ | Relative Speed |
|---|---|---|---|
| Control A | | | |
| Red | 0.100 | 2.504 | 128.2 |
| Green | 0.088 | 2.424 | 125.5 |
| Blue | 0.062 | 2.015 | 145.2 |

The invention has been described in detail with particular reference to preferred embodiments thereof, but it will be understood that variations and modifications can be effected within the spirit and scope of the invention.

We claim:

1. A photographic color developer composition comprising:

a) a photographic color developer, and b) a substituted hydroxylamine antioxidant which has the structure (I):

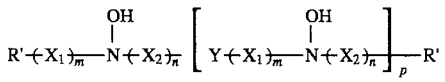

wherein

R' is an alkyl group of 1 to 10 carbon atoms, a hydroxyalkyl group of 1 to 10 carbon atoms, a cycloalkyl group of 5 to 10 carbon atoms, or an aryl group having 6 to 10 carbon atoms in the aromatic nucleus, $X_1$ has the structure (II):

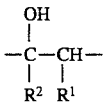

and $X_2$ has the structure (III):

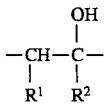

wherein $R^1$ and $R^2$ are independently hydrogen, an alkyl group of 1 to 2 carbon atoms, or a hydroxyalkyl group of 1 to 2 carbon atoms, or $R^1$ and $R^2$ together represent the carbon atoms necessary to complete a 5- to 8-membered saturated or partially saturated carbocyclic ring structure, Y is an alkylene group of at least 4; carbon atoms and has an even number of carbon atoms, or Y is a divalent aliphatic group having an even total number of carbon and oxygen atoms in the chain, provided that said divalent aliphatic group has at least 4 atoms in the chain, m and n are 1, and p is 0 or 1, the antioxidant being a reaction product formed in a reaction mixture from the reaction of:

1) hydroxylamine or a mono-substituted hydroxylamine, and 2) an epoxide having either the structure (IV):

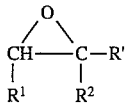

or (V):

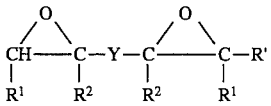

wherein R', $R^1$, $R^2$ and Y are defined above, said reaction product remaining in said reaction mixture for use as an antioxidant when mixed with said photographic color developer.

2. The composition of claim 1 wherein R' is an alkyl group of 1 to 7 carbon atoms, a hydroxyalkyl group of 1 to 3 carbon atoms, a cyclohexyl group or a phenyl group, $R^1$ and $R^2$ are independently an alkyl group of 1 to 2 carbon atoms or a hydroxyalkyl of 1 to 2 carbon atoms and Y is an alkylene group of at least 4 carbon atoms.

3. The composition of claim 1 wherein said mono-substituted hydroxylamine is N-methylhydroxylamine, N-isopropylhydroxylamine or N-cyclohexylhydroxylamine.

4. The composition of claim 1 wherein said epoxide is glycidol, 2-methyl-2,3-epoxy-1-propanol, 4-phenyl-2,3-epoxy-1-butanol, 1,4-butanediol diglycidyl ether and 1,2,7,8-diepoxyoctane.

5. The composition of claim 1 wherein said photographic color developer is an aminophenol or a p-phenylenediamine.

6. The composition of claim 1 further comprising a compound selected from the group consisting of: an alkali metal halide, a sequestering agent, a buffer, a preservative, a development accelerator, an optical brightening agent, a wetting agent, a surfactant and a water-soluble or water-dispersible coupler.

7. The composition of claim 1 wherein said substituted hydroxylamine antioxidant is N,N-bis(2,3-dihydroxypropyl)hydroxylamine, N,N-bis(2-methyl-2,3-dihydroxypropyl-)hydroxylamine or N,N-bis(1-hydroxymethyl-2-hydroxy-3-phenylpropyl)hydroxylamine.

8. A method for developing a color photographic element comprising:

treating an imagewise exposed and undeveloped color photographic element with a color developer composition comprising:

a) a photographic color developer, and b) a substituted hydroxylamine antioxidant which has the structure (I):

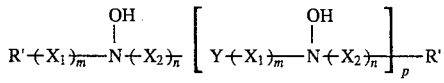

wherein

R' is an alkyl group of 1 to 10 carbon atoms, a hydroxyalkyl group of 1 to 10 carbon atoms, a cycloalkyl group of 5 to 10 carbon atoms, or an aryl group having 6 to 10 carbon atoms in the aromatic nucleus, $X_1$ has the structure (II):

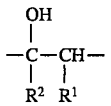

and $X_2$ has the structure (III):

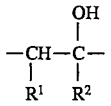

wherein $R^1$ and $R^2$ are independently hydrogen, an alkyl group of 1 to 2 carbon atoms, or a hydroxyalkyl group of 1 to 2 carbon atoms, or $R^1$ and $R^2$ together represent the carbon atoms necessary to complete a 5- to 8-membered saturated or partially saturated carbocyclic ring structure, Y is an alkylene group of at least 4 carbon atoms and has an even number of carbon atoms, or Y is a divalent aliphatic group having an even total number of carbon and oxygen atoms in the chain, provided that said divalent aliphatic group has at least 4 atoms in the chain, m and n are 1 and p is 0 or 1, the antioxidant being a reaction product formed in a reaction mixture from the reaction of:

1) hydroxylamine or a mono-substituted hydroxylamine, and 2) an epoxide having either the structure (IV):

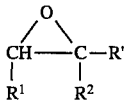

or (V):

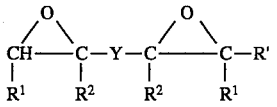

wherein R', $R^1$, $R^2$ and Y are defined above, said reaction product remaining in said reaction mixture for use as an antioxidant when mixed with said photographic color developer.

9. The method of claim 8 wherein said color photographic element is a color photographic paper.

10. The method of claim 8 wherein R' is an alkyl group of 1 to 7 carbon atoms, a hydroxyalkyl group of 1 to 3 carbon atoms, a cyclohexyl group or a phenyl group, $R^1$ and $R^2$ are independently an alkyl group of 1 to 2 carbon atoms or a hydroxyalkyl group of 1 to 2 carbon atoms, and Y is an alkylene group of at least 4 carbon atoms.

11. The method of claim 8 wherein said mono-substituted hydroxylamine is N-methylhydroxylamine, N-isopropylhydroxylamine or N-cyclohexylhydroxylamine, and said epoxide is glycidol, 2-methyl-2,3-epoxy-1-propanol, 4-phenyl-2,3-epoxy-1-butanol, 1,4-butanediol diglycidyl ether and 1,2,7,8-diepoxyoctane.

12. The method of claim 8 wherein said photographic color developer is an aminophenol or a p-phenylenediamine.

13. The method of claim 8 wherein said substituted hydroxylamine antioxidant is N,N-bis(2,3-dihydroxypropyl)hydroxylamine, N,N-bis(2-methyl-2,3-dihydroxypropyl)hydroxylamine or N,N-bis(1-hydroxymethyl-2-hydroxy-3-phenylpropyl)hydroxylamine.

14. The method of claim 8 further comprising bleaching said color photographic element after treatment with said color developer composition.

* * * * *